US008139989B2

(12) United States Patent
Ohgoshi et al.

(10) Patent No.: US 8,139,989 B2
(45) Date of Patent: Mar. 20, 2012

(54) TONER BOTTLE HAVING A RUBBING MEMBER AND IMAGE FORMING APPARATUS INCLUDING SAME

(75) Inventors: Toshihide Ohgoshi, Nara (JP); Koichi Mihara, Fujiidera (JP)

(73) Assignee: Sharp Kabushiki Kaisha, Osaka (JP)

( * ) Notice: Subject to any disclaimer, the term of this patent is extended or adjusted under 35 U.S.C. 154(b) by 435 days.

(21) Appl. No.: 12/368,663

(22) Filed: Feb. 10, 2009

(65) Prior Publication Data

US 2009/0208253 A1 Aug. 20, 2009

(30) Foreign Application Priority Data

Feb. 15, 2008 (JP) ..... P2008-035354

(51) Int. Cl.
*G03G 15/08* (2006.01)

(52) U.S. Cl. ..... 399/263; 399/262

(58) Field of Classification Search ..... 399/119, 399/258, 260, 262, 263
See application file for complete search history.

(56) References Cited

U.S. PATENT DOCUMENTS

| | | | | |
|---|---|---|---|---|
| 5,581,334 | A * | 12/1996 | Forlani et al. | 399/263 |
| 2002/0150410 | A1 | 10/2002 | Matsuda et al. | |
| 2006/0034642 | A1 | 2/2006 | Taguchi et al. | |
| 2006/0222414 | A1 | 10/2006 | Yamamura | |
| 2007/0264051 | A1 | 11/2007 | Tanaka | |

FOREIGN PATENT DOCUMENTS

| | | | |
|---|---|---|---|
| JP | 05072952 | A * | 3/1993 |
| JP | 08-179612 | | 7/1996 |
| JP | 9-34233 | A | 2/1997 |
| JP | 11219009 | A * | 8/1999 |
| JP | 11-305531 | | 11/1999 |
| JP | 2000-147887 | | 5/2000 |
| JP | 2002-296884 | A | 10/2002 |
| JP | 2005-309195 | | 4/2005 |
| JP | 2005-309195 | | 11/2005 |
| JP | 2006-053446 | | 2/2006 |
| JP | 2006-276615 | A | 10/2006 |
| JP | 2006-350096 | A | 12/2006 |
| JP | 2007-304281 | A | 11/2007 |

* cited by examiner

*Primary Examiner* — David Porta
*Assistant Examiner* — Milton Gonzalez
(74) *Attorney, Agent, or Firm* — Nixon & Vanderhye P.C.

(57) ABSTRACT

A toner bottle includes a bottle main body for discharging toner contained therein by rotation of the bottle main body and a scraping member disposed inside the bottle main body for rubbing the inner wall surface of the bottle main body 20 by rotation of the bottle main body. A shaft section for supporting a rubbing section included in the scraping member has an inclined support section extending with a predetermined angle inclined in a direction deviating from a direction in which an axis of rotation of the bottle main body extends.

15 Claims, 7 Drawing Sheets

TONER BOTTLE HAVING A RUBBING MEMBER AND IMAGE FORMING APPARATUS INCLUDING SAME

CROSS-REFERENCE TO RELATED APPLICATION

This application claims priority to Japanese Patent Application No. 2008-035354, which was filed on Feb. 15, 2008, the contents of which are incorporated herein by reference in its entirety.

BACKGROUND OF THE INVENTION

1. Field of the Invention

The present invention relates to a rotary type toner bottle for containing toner to be supplied to a developing section for developing an electrostatic charge image on the surface of a photoreceptor, and an image forming apparatus.

2. Description of the Related Art

There is an electrophotographic image forming apparatus having a toner bottle for containing toner which is detachably disposed in a predetermined toner containing section and is adapted to supply toner to a developing section by rotation of the toner bottle.

In such an image forming apparatus, toner fluidity is maintained by adding a fluidity improver such as colloidal silica to toner. However, in recent years, since a particle diameter of toner has become small accompanied with higher-speed and higher-definition in image forming apparatuses, the toner fluidity is lowered so that toner remains in a toner bottle and therefore easily aggregates to each other. Especially, in a toner bottle that includes protrusions (ribs) on the inner wall surface, in which the rib guides and transports the toner contained therein by rotation of the rib, toner moves slowly between ribs and toner is therefore likely to generate heat and aggregate to each other. Hence, in order to suppress the heat generation from toner at the ribs provided inside the toner bottle as much as possible, there is a toner bottle, in which a continuous rib is changed to divided ones.

Further, Japanese Unexamined Patent Publication JP-A 2006-53446 discloses a toner bottle including a transporting member such as a coil inside. In the toner bottle disclosed in JP-A 2006-53446, since the transporting member is rotated to guide and transport toner contained therein, it is possible to improve the transporting performance of toner in the toner bottle. However, the toner bottle disclosed in JP-A 2006-53446 is constituted such that the transporting member is rotated whereas the bottle main body is not rotated, thus toner is likely to remain in the end or the inner wall surface of the bottle main body. As a result, there is a case where toner aggregation is generated inside the bottle main body.

Further, JP-A 11-305531 (1999) discloses a toner bottle including a softening member near an opening serving as an outlet for discharging toner contained in a bottle main body to a developing section. In the toner bottle disclosed in JP-A 11-305531, when toner fed from the opening aggregates, the aggregated toner is softened by the softening member, thus making it possible to suppress the toner aggregation near the opening. However, in the toner bottle disclosed in JP-A 11-305531, even when the toner aggregation near the opening is suppressed, the toner aggregation over the whole area in a direction in which an axis of rotation of the bottle main body extends can not be suppressed. Further, since one end of the softening member is fixed to the bottle main body, movement of the softening member becomes small and softening effect becomes small even near the opening part. Especially near the end on the fixed side where the softening member is fixed, the aggregated toner can be hardly softened.

FIG. 6 is a perspective view showing the structure of a toner bottle 50 in a related art. In addition, FIG. 7 is a perspective view showing the structure of a scraping member 70 disposed in the toner bottle 50. The toner bottle 50 includes a bottle main body 60 and the scraping member 70. The bottle main body 60 is formed in a cylindrical shape and has a toner feeding section 61 and a connecting section 62, and a plurality of ribs 63 which are not continuous are formed on the inner wall surface of the bottle main body 60.

The toner feeding section 61 is disposed at one end of the bottle main body 60 which end is to be arranged on a front side (hereinafter referred to as W side) of an image forming apparatus so as to be opened in a direction in which an axis of the bottle main body 60 extends and serves as an outlet for feeding toner into the bottle main body 60. An opening of the toner feeding section 61 has a diameter smaller than an inner diameter of the bottle main body 60 and is sealed by a cap 61C. The connecting section 62 is provided at an end of the bottle main body 60 which end is to be arranged on a rear side (hereinafter referred to as R side) of the image forming apparatus. The connecting section 62 has a protrusion for regulating movement in a direction perpendicular to the direction in which the axis of the bottle main body 60 extends. The protrusion is engaged with a driving shaft of a driving source, and a driving force is transmitted to the bottle main body 60 to rotate the bottle main body 60. The ribs 63 are formed on the inner wall surface of the bottle main body 60 with a predetermined angle inclined to a direction perpendicular to the direction in which the axis line of the bottle main body 60 extends so that when the bottle main body 60 is rotated, toner is transported toward the toner opening as an outlet for discharging toner.

The scraping member 70 includes a shaft section 71 and two rubbing sections 72 and 73. The shaft section 71 serves as a shaft that extends in parallel with a direction in which the axis of rotation of the bottle main body 60 extends and supports the rubbing sections 72 and 73. The rubbing sections 72 and 73 are disposed so as to be in contact with the inner wall surface of the bottle main body 60 and scrape toner attached to the inner wall surface of the bottle main body 60 when the bottle main body 60 is rotated around the axis.

In the toner bottle 50, as described above, when the bottle main body 60 is rotated, the scraping member 70 scrapes toner attached to the inner wall surface of the bottle main body 60 and the ribs 63 guide and transport toner contained in the bottle main body 60. At this time, in the toner bottle 50, since the shaft section 71 of the scraping member 70 extends in parallel with a direction in which the axis of rotation of the bottle main body 60 extends to support the rubbing sections 72 and 73, the capability of scraping attached toner is the same in the rubbing sections 72 and 73.

Therefore, when toner contained in the bottle main body 60, including toner scraped by the scraping member 70, is guided and transported by the ribs 63 to the other end of the bottle main body 60 on the K side of the image forming apparatus that is in a downstream side in a transporting direction, toner quantity is increased as advancing toward the downstream side in the transporting direction. As a result, toner is likely to be aggregated at the end of the downstream side in the transporting direction inside the bottle main body 60 and it is impossible to teed toner stably from the opening for discharging toner.

SUMMARY OF THE INVENTION

An object of the invention is to provide a toner bottle capable of reducing the quantity of residual toner which remains unfed, by scraping toner adhered to an inner wall surface of the toner bottle, and of stably feeding toner while suppressing generation of toner aggregation, and an image forming apparatus including the toner bottle.

The invention provides a toner bottle for containing toner to be supplied to a developing section for developing an electrostatic latent image on a surface of a photoreceptor, comprising;

a bottle main body in a cylindrical shape for supplying toner contained therein to the developing section by rotation of the bottle main body; and a rubbing member disposed inside the bottle main body for rubbing an inner wall surface of the bottle main body by rotation of the bottle main body, wherein the bottle main body has:

a toner opening which serves as an outlet for supplying toner to the developing section; and one or more ribs protruding from the inner wall surface of the bottle main body and formed in a discrete manner, for guiding and transporting toner to the toner opening by rotation of the bottle main body, wherein the rubbing member has:

a shaft section disposed over a whole area in a direction in which an axis of rotation of the bottle main body extends; and a rubbing section having one end supported by the shaft section and another end formed so as to be in contact with the inner wall surface of the bottle main body, wherein the shaft section has an inclined support section extending inclined with a predetermined angle in a direction deviating from the direction in which the axis of rotation of the bottle main body extends to support the rubbing section, and wherein the rubbing section is supported by the inclined support section so as to extend in a direction perpendicular to the deviating direction.

According to the invention, since the rubbing section supported by the shaft section of the rubbing member is formed so as to be in contact with the inner wall surface of the bottle main body, it is possible, when the bottle main body is rotated, to scrape toner adhered to the inner wall surface of the bottle main body by the rubbing section to reduce the quantity of residual toner remaining unfed. Further, when the bottle main body is rotated, the one or more ribs guide and transport toner contained in the bottle main body to the toner opening. At this time, since the inclined support section extending inclined with a predetermined angle in a direction deviating from the direction in which the axis of rotation of the bottle main body extends has the rubbing section supported so as to extend in a direction perpendicular to the deviating direction, when the bottle main body is rotated, the rubbing section scrapes toner adhered to inner wall surface of the bottle main body, while pushing and transporting toner contained in the bottle main body to the toner opening. In this way, since the toner contained in the bottle main body is guided and transported by the one or ore ribs, as well as pushed and transported by the rubbing section supported by the inclined support section, it is possible to improve the capability of transporting toner. Accordingly, it is possible to prevent that the toner quantity in the bottle main body is increased toward the toner opening, as in a case where all rubbing sections are supported by the shaft section extending in parallel with the direction in which the axis of rotation of the bottle main body extends. As a result, it is possible to prevent toner for being aggregated near the toner opening and to discharge toner stably from the toner opening.

Furthermore, in the invention, it is preferable that the shaft section has a plurality of the inclined support sections formed repeatedly.

According to the invention, the shaft section of the rubbing section has a plurality of the inclined support sections formed repeatedly. Accordingly, it is possible to further improve the capability of transporting toner contained in the bottle main body.

Furthermore, in the invention, it is preferable that the rubbing section is a comb-like sheet member.

According to the invention, the rubbing section is a comb-like sheet member. Accordingly, the rubbing section is formed with an appropriate elasticity applied. As a result, it is possible to scrape toner adhered to a small gap such as the rib formed in the bottle main body.

Furthermore, in the invention, it is preferable that the rubbing section is made of polyethylene terephthalate resin.

According to the invention, the rubbing section is made of a polyethylene terephthalate resin. The polyethylene terephthalate resin has an elasticity and greater strength, as well as does not react chemically with toner, thus toner adhered to the inner wall surface of the bottle main body is efficiently scraped and toner aggregation is further suppressed.

Furthermore, in the invention, it is preferable that the rubbing section made of polyethylene terephthalate resin has a thickness of not less than 0.05 mm and not more than 0.3 mm.

According to the invention, the rubbing section made of polyethylene terephthalate resin has a thickness of not less than 0.05 mm and not more than 0.3 mm. By setting the thickness of the rubbing section to not less than 0.05 mm, it is possible to sufficiently acquire the capability of transporting toner contained in the bottle main body. In addition, by setting the thickness of the rubbing section to not more than 0.3 mm, it is possible to prevent that the stiffness of the rubbing section becomes too high, and it is possible to prevent that the rubbing section moves vertically or slides upwardly in the bottle main body when the rubbing section scrapes toner adhered to the inner wall surface of the bottle main body, Furthermore, in the invention, it is preferable that each angle formed by a virtual extension line in a long axis side of each of the plurality of inclined support sections and the direction in which the axis of rotation of the bottle main body extends is set to not less than 50 and not more than 30°.

According to the invention, each angle formed by a virtual extension line in a long axis side of each of the plurality of inclined support sections and the direction in which the axis of rotation of the bottle main body extends is set to not less than 5° and not more than 30°. By setting the angles to not less than 5°, it is possible to sufficiently acquire the capability of transporting toner contained in the bottle main body by the rubbing section supported by the inclined support section. In addition, by setting the angle to not more than 30°, it is possible to prevent that toner contained in the bottle main body is reversed in an opposite direction to the transporting direction by the rubbing section supported by the inclined support section, and to sufficiently acquire the capability of transporting toner contained in the bottle main body by the rubbing section.

Furthermore, in the invention, it is preferable that each angle formed by a virtual extension line in a long axis side of each of the plurality of inclined support sections and the direction in which the axis of rotation of the bottle main body extends is set to be larger toward the toner opening.

According to the invention, each angle formed by a virtual extension line in a long axis side of each of the plurality of inclined support sections and the direction in which the axis of rotation of the bottle main body extends is set to be larger toward the toner opening. Accordingly, it is possible to improve the capability of scraping and transporting adhered toner by the rubbing section supported by the inclined support section toward the toner opening Furthermore, the invention provides an image forming apparatus comprising an image recording unit including a developing section for developing an electrostatic latent image on a surface of a photoreceptor drum with toner, and the toner bottle mentioned above, wherein the toner bottle is adapted to supply toner to the developing section.

According to the invention, an image forming apparatus includes an image recording unit that includes the toner bottle capable of scraping and transporting toner adhered to the inner wall surface of the bottle main body by a rubbing member having the rubbing section supported by the inclined support section to enable efficient toner transportation while suppressing generation of toner aggregation. In the image forming apparatus, the toner bottle is adapted to supply toner to the developing section, thus making it possible to form an image on a recording medium in a state where toner is capable of being supplied efficiently.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
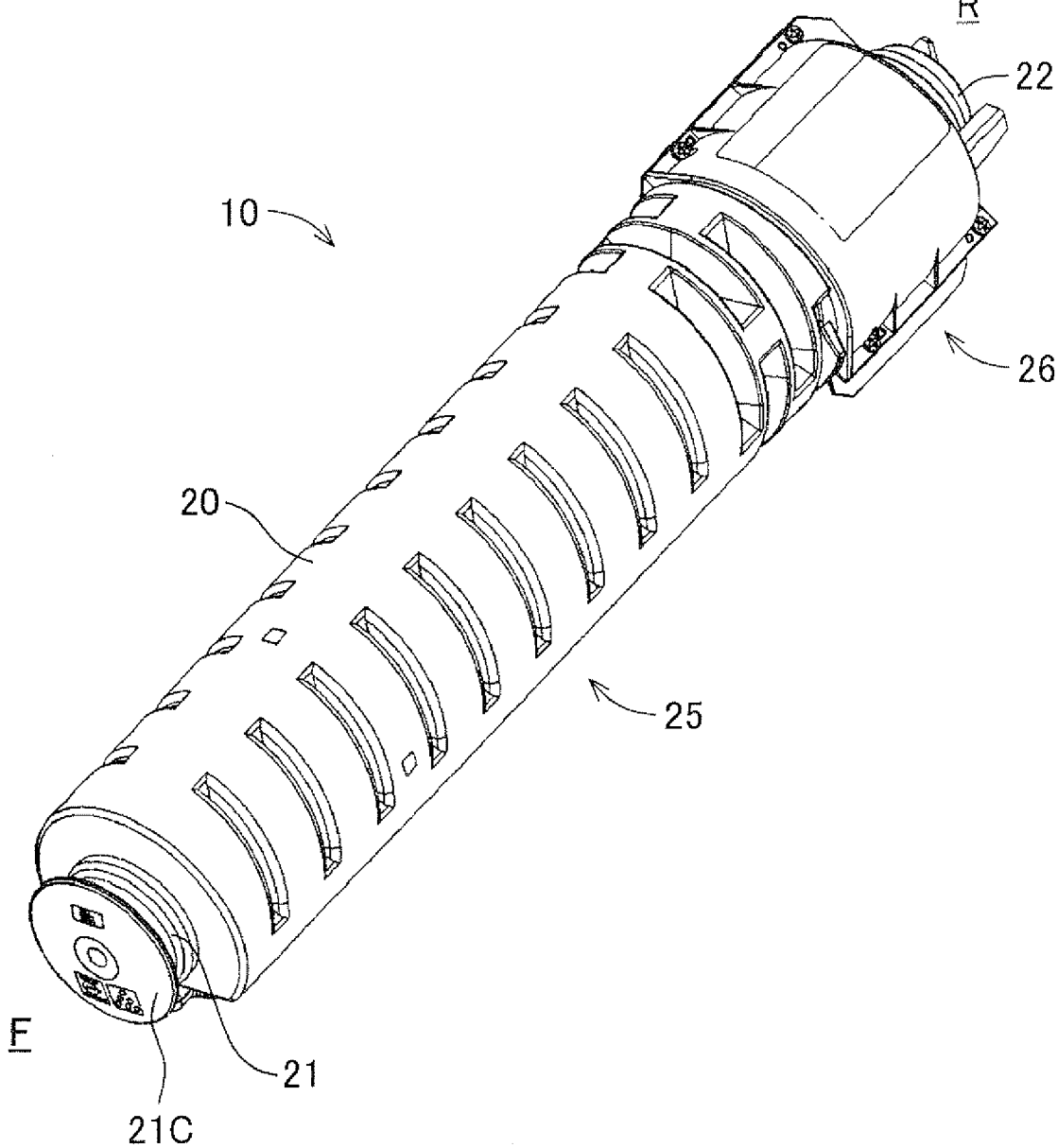
FIG. 1 is a perspective view showing the structure of a toner bottle according to an embodiment of the invention.

Now referring to the drawings, preferred embodiments of the invention are described below.

Figure 2:
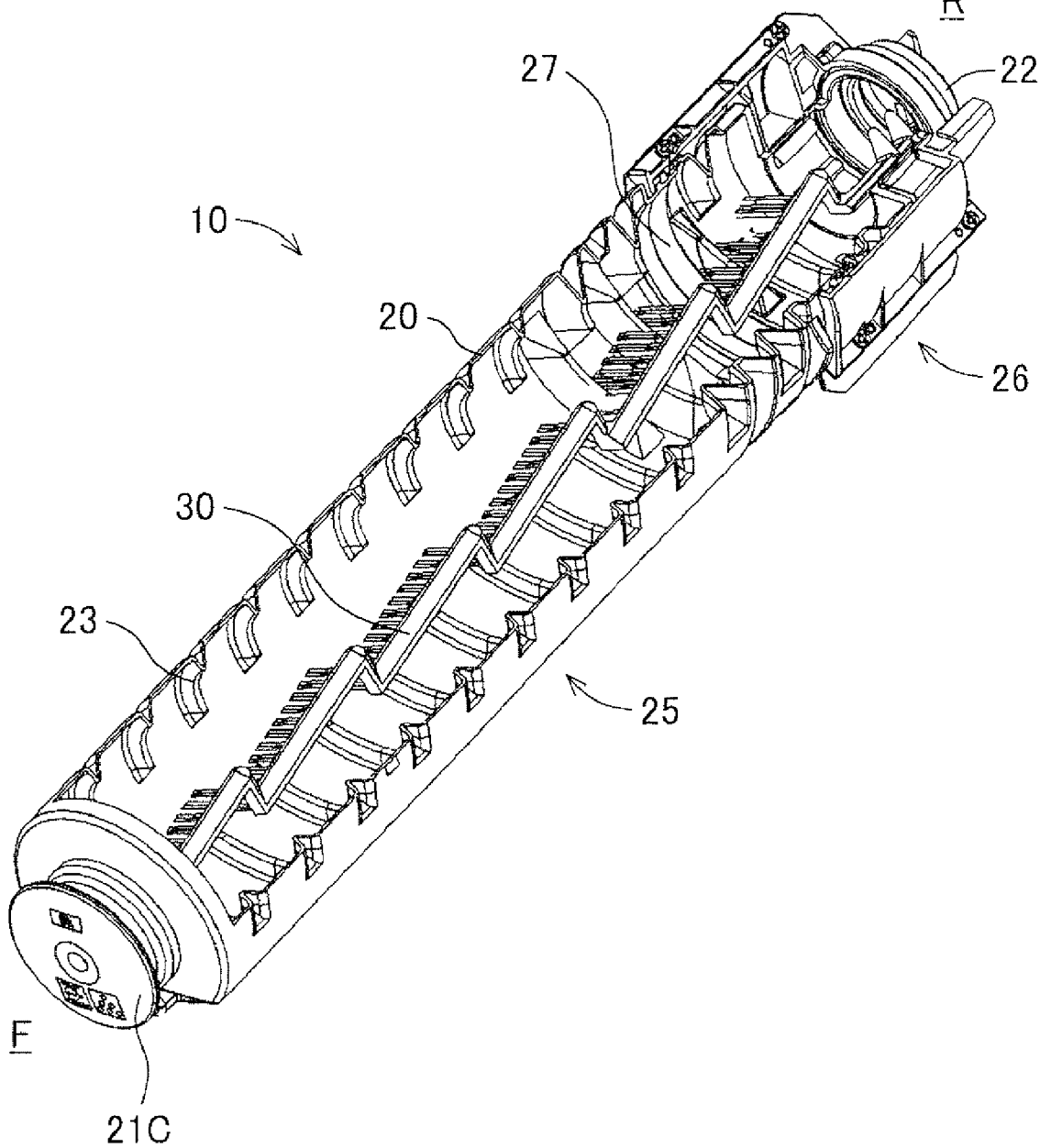
FIG. 2 is a partially cutaway perspective view showing the structure of the toner bottle when viewed from a front side.

FIG. 1 is a perspective view showing the structure of a toner bottle 10 according to an embodiment of the invention. In addition, FIG. 2 is a partially cutaway perspective view showing the structure of the toner bottle 10 when viewed from F side of an image forming apparatus. The toner bottle 10 transports toner contained therein toward a toner opening (not shown) by rotation of the toner bottle and supplies the toner fed from the toner opening to a developing section 302 included in an image forming apparatus 100 described below. The toner bottle 10 includes a bottle main body 20 and a scraping member 30.

The bottle main body 20 is formed into a cylindrical shape and has a toner feeding section 21 and a connecting section 22. The toner feeding section 21 is disposed at one end in the F side that is in an upstream side in the transporting direction transporting toner in the bottle main body 20 so as to be opened in a direction in which an axis of rotation of the bottle main body 20 extender and serves as an outlet for feeding toner into the bottle main body 20. An opening of the toner feeding section 21 has a diameter smaller than an inner diameter of the bottle main body 20 and is sealed by a cap 21C. The connecting section 22 is disposed at another end on R side that is in a downstream side in the transporting direction transporting toner in the bottle main body 20. The connecting section 22 has a protrusion for regulating movement in a direction perpendicular to the direction in which the axis of rotation of the bottle main body 20 extends. This protrusion is engaged with a driving shaft of a driving source 311 included in the image forming apparatus 100 described below, a driving force supplied from the driving source 311 is transmitted to the bottle main body 20 to rotate the bottle main body 20.

Further, the bottle main body 20 is classified into a first region 25 which is a region located in the upstream side in the transporting direction transporting toner and a second region 26 which is a region located in the downstream side in the transporting direction. In addition, a plurality of ribs 23 are formed protruding from the inner wall surface inside the first region 25. The ribs 23 are formed with a predetermined angle inclined to a direction perpendicular to the direction in which the axis of rotation of the bottle main body 20 extends so that when the bottle main body 20 is rotated, toner is transported toward the toner opening. Each of the ribs 23 has a length in a circumferential direction that is set, for example, to the length of not more than half of the circumference of the bottle main body 20.

Inside the second region 26, a protrusion section 27 is formed protruding from the inner wall surface, thus an inner space of the second region 26 is narrower than the inner space of the first region 25. Similarly to the aforementioned ribs 23, the protrusion section 27 transports toner to the toner opening in the second region 26, when the bottle main body 20 is rotated.

Figure 3:
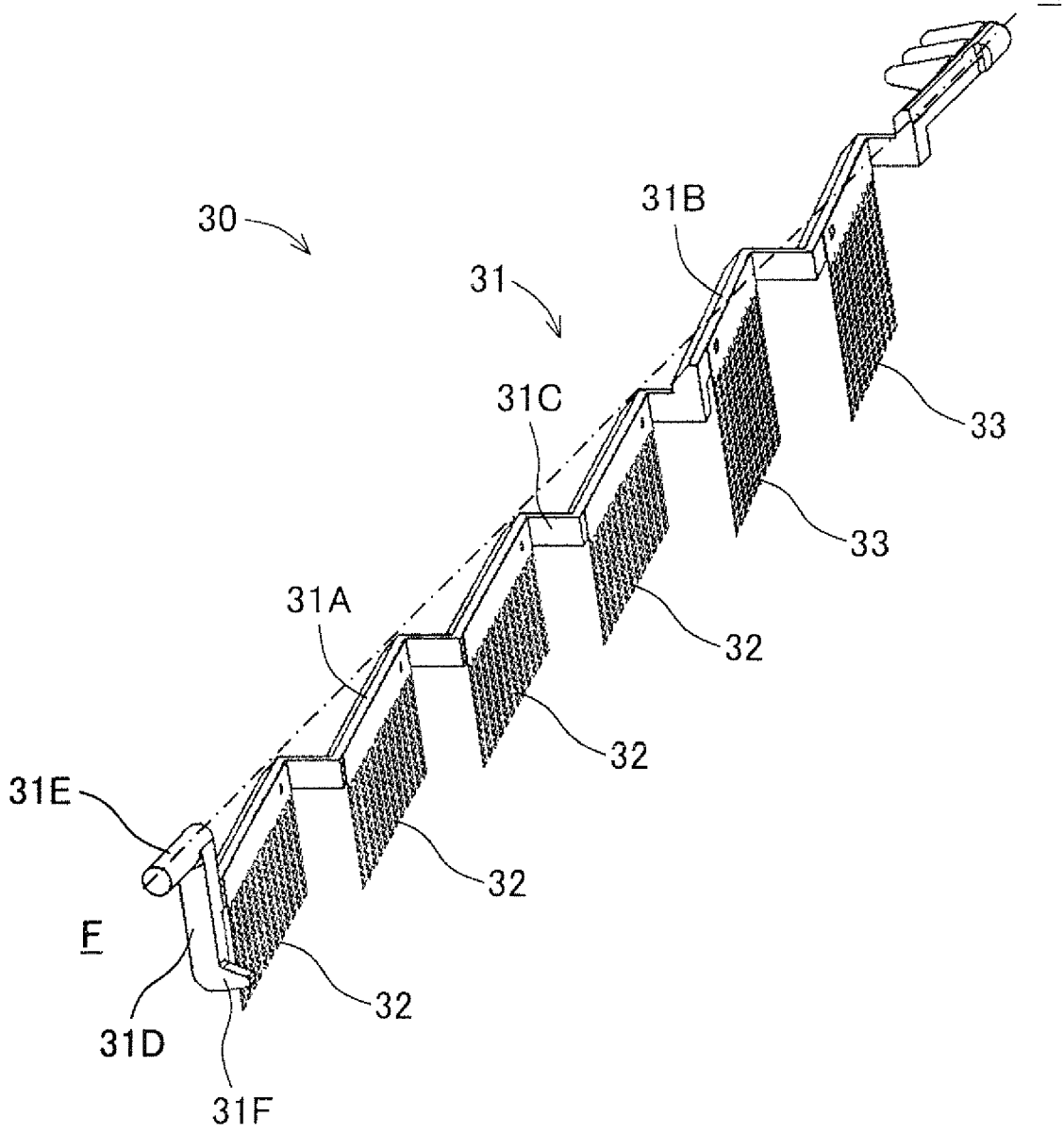
FIG. 3 is a perspective view showing the structure of a scraping member disposed in the toner bottle.
Figure 4:
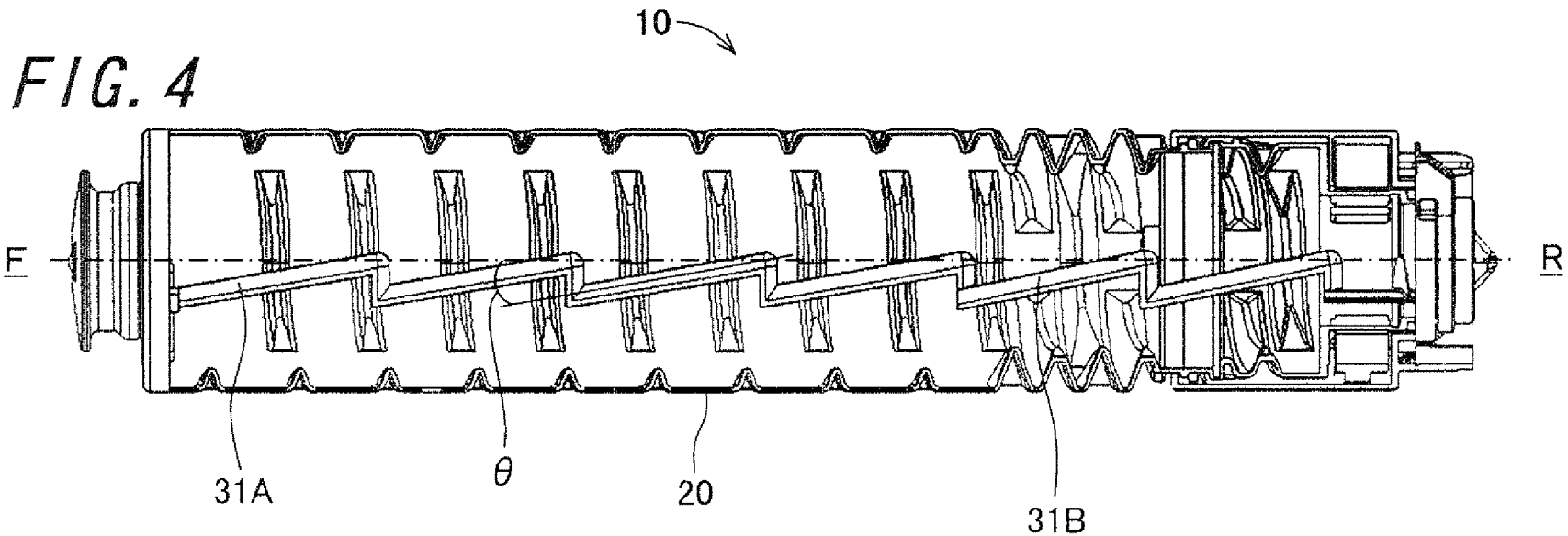
FIG. 4 is a view of the disposed state of the scraping member in the toner bottle when viewed from the top.

FIG. 3 is a perspective view showing the structure of the scraping member 30 disposed in the toner bottle 10. In addition, FIG. 4 is a view of the disposed state of the scraping member 30 in the toner bottle 10 when viewed from the top. The scraping member 30 is a rubbing member of the invention, which is disposed inside the bottle main body 20 and rubs the inner wall surface of the bottle main body 20, when the bottle main body 20 is rotated. Moreover, the scraping member 30 is constituted by including a shaft section 31, a first rubbing section 32 and a second rubbing section 33.

The shaft section 31 is disposed over the whole area in the direction in which the axis of rotation of the bottle main body 20 extends and serves as a shaft for supporting the first rubbing section 32 and the second rubbing section 33 described below. The shaft section 31 includes a first inclined support section 31A, a second inclined support section 313, a coupling section 31C, a vertical section 31D, an extension section 31E, and an engagement section 31F.

The vertical section 31D is disposed perpendicular to the first inclined support section 31A described below, and the end on the F side of the first inclined support section 31A is fixed to a center part of the vertical section 31D. The extension section 31E is formed so as to extend in the same direction as the center axis of the bottle main body 20 and is extended to the F side from one end of the vertical section 31D. In a state where the scraping member 30 is disposed inside the bottle main body 20, the extension section 31E is inserted into the toner feeding section 21 and the vertical section 31D is interfered with the end surface on the F side of the bottle main body 20. When the vertical section 31D is interfered with the end surface on the F side of the bottle main body 20, the scraping member 30 is prevented from falling and dropping from the bottle main body 20. The engagement section 31F is extended from the end of the vertical section 31D opposite to the extension section 31E in one direction perpendicular to both of the first inclined support section 31A and the vertical section 31D, and is engaged with the bottle main body 20 so as not to rotate the scraping member 30.

The first inclined support section 31A is a part disposed in the first region 25 of the bottle main body 20, and extends inclined with a predetermined angle in a direction deviating from the direction in which the axis of rotation of the bottle main body 20 extends to support the first rubbing section 32 described below. The second inclined support section 31B is a part disposed in the second region 26 of the bottle main body 20, and extends inclined with a predetermined angle in a direction deviating from the direction in which the axis of rotation of the bottle main body 20 extends to support the second rubbing section 33 described below.

In the toner bottle 10, as described above, when the bottle main body 20 is rotated, the ribs 23 and the protrusion section 27 guide and transport the toner contained in the bottle main body 20 to the toner opening. At this time, since the toner bottle 10 has the first rubbing section 32 supported by the first inclined support section 31A and the second rubbing section 33 supported by the second inclined support section 31B, when the bottle main body 20 is rotated, the first rubbing section 32 and the second rubbing section 33 scrape toner adhered to the inner wall surface of the bottle main body 20, as well as push and transport toner contained in the bottle main body 20 to the toner opening.

In this way, the toner contained in the bottle main body 20 is guided and transported by the ribs 23 and the protrusion section 27, as wall as pushed and transported by each of the rubbing sections 32 and 33 supported by each of the inclined support sections 31A and 31B, thus making it possible to improve the capability of transporting toner. Accordingly, it is possible to prevent that the toner quantity in the bottle main body 20 is increased toward the toner opening. As a result, it is possible to prevent the toner from being aggregated near the toner opening and to feed the toner from the toner opening stably.

Further, as described above, a plurality of ribs 23 for transporting toner are formed on the inner wall surface of the bottle main body 20 in a discrete manner. In such a rib 23, the transporting performance is deteriorated in an area where the rib 23 is interrupted. However, in the invention, each of the rubbing sections 32 and 33 supported by the respective inclined support sections 31A and 31B is provided to improve the capability of transporting toner, thus making it possible to compensate the deterioration in the toner transporting performance in the area where the rib 23 is interrupted.

Further, in this embodiment, the shaft section 31 has a plurality of the first inclined support sections 31A and the second inclined support sections 31B formed repeatedly, and adjacent inclined support sections are coupled through the coupling sections 31C in all of the first inclined support sections 31A and the second inclined support sections 31B. In addition, although angles θ formed by virtual extension lines in the long axis side of each of the plurality of first inclined support sections 31A and second inclined support sections 31B and the direction in which the axis of rotation of the bottle main body 20 extends are set all the same to 15°, the angle θ is preferably set to not less than 5° and not more than 30°. When the angle θ is less than 5°, the capability of transporting toner in the rubbing sections 32 and 33 described below supported by each of the inclined support section 31A and 313 becomes too low. In addition, when the angle θ exceeds 30°, there is a case where the toner contained in the bottle main body 20 is reversed in an opposite direction to the transporting direction by the rubbing sections 32 and 33 supported by each of the inclined support sections 31A and 31B, and the quantity of reversed toner is increased to adversely deteriorate the capability of transporting toner by the rubbing sections 32 and 33. Further, the plurality of the first inclined support sections 31A and the second inclined support sections 31B have the same direction deviating from the axis of rotation of the bottle main body 20. In addition, each length in the long axis side of the plurality of the first inclined support sections 31A and the second inclined support sections 31B is set to be the same. In this way, the plurality of the first inclined support sections 31A and the second inclined support sections 31B are formed repeatedly in the shaft section 31, thus making it possible to further improve the capability of transporting toner contained in the bottle main body 20.

Moreover, the angle θ formed by virtual extension lines in the long axis side of each of the plurality of first inclined support sections 31A and second inclined support sections 31B and the direction in which the axis of rotation of the bottle main body 20 extends may be set so as to be larger in a range of 5° to 30° toward the toner opening serving as an outlet for discharging toner. At this time, the angle θ corresponding to each of the plurality of the inclined support sections 31A and 31B each is set such that a difference of the angle θ between the adjacent inclined support sections is set to in a range of 5° to 10°.

Here, the angle θ corresponding to each of the plurality of the inclined support sections 31A and 31B may be changed one by one, respectively, or the angles θ may be such that the first inclined support sections 31A have the same angles θ and the second inclined support sections 31B have the same angles θ while the angles θ of the second inclined support section 31B are set larger than the angles θ of the first inclined support section 31A. Accordingly, it is possible to improve the capability of scraping and transporting the adhered toner by each of the rubbing sections 32 and 33 supported by the respective inclined support sections 31A and 31B toward the toner opening.

Further, directions deviating from the axis of rotation of the bottle main body 20 in the plurality of the first inclined support sections 31A and the second inclined support sections 31B may be set alternately. In addition, the length in the long axis side of each of the plurality of the first inclined support sections 31A and the second inclined support sections 31B may be changed. When the length in the long axis side of each of the inclined support sections 31A and 31B is changed, the length of the second inclined support sections 31B is preferably set shorter than that of the first inclined support sections 31A. In this way, by setting the length in the long axis side of each of the inclined support sections 31A and 31B, it is possible to improve the capability of scraping and transporting adhered toner by each of the rubbing sections 32 and 33 supported by the respective inclined support sections 31A and 31B near the toner opening.

A first rubbing section 32 is formed so as to have one end supported and fixed by the first inclined support section 31A and another end as a free end being in contact with the inner wall surface of the bottle main body 20. At this time, a direction in which the first rubbing section 32 extends from one end to the other end is perpendicular to a direction of the first inclined support section 31A deviating from the axis of rotation of the bottle main body 20. The second rubbing section 33 is formed in the same manner as the first rubbing section 32 except that one end is supported and fixed by the second inclined support section 31B. Here, when one end of each of the rubbing sections 32 and 33 is fixed to each of the inclined support sections 31A and 31B, firstly, one end of each of the rubbing sections 32 and 33 is attached to each of the inclined support sections 31A and 31B with a double-sided tape. Thereafter, each of the rubbing sections 32 and 33 is thermally bonded to be fixed to each of the inclined support sections 31A and 31B at a plurality of positions with a predetermined interval.

Since the first rubbing section 32 and the second rubbing section 33 are formed so as to be in contact with the inner wall surface of the bottle main body 20, when the bottle main body 20 is rotated, it is possible to scrape toner adhered to the inner wall surface of the bottle main body 20 by each of the rubbing sections 32 and 33 and to reduce the quantity of residual toner that remains unfed from the bottle main body 20.

In addition, in this embodiment, the first rubbing section 32 and the second rubbing section 33 are a sheet member made of a polyethylene terephthalate resin and have a comb-like outer shape. At this time, the top ends of the comb teeth as the free ends of the rubbing sections 32 and 33 are arranged in a direction parallel to a direction in which the inclined support sections 31A and 31B extend and formed so as to be in contact with the inner wall surface of the bottle main body 20. The first rubbing section 32 and the second rubbing section 33 formed into a comb-like shape and made of a polyethylene terephthalate resin, have elasticity and greater strength as well as do not react chemically with toner. Accordingly, it is possible to efficiently scrape even toner adhered to a small gap such as the rib 23 formed in the bottle main body 20, resulting that the toner aggregation is further suppressed, Further, the first rubbing section 32 and the second rubbing section 33 may be formed from a material containing additives for giving electrical conductivity to a polyethylene terephthalate resin Thereby, it is possible to prevent generation of toner adhesion due to static electricity in the respective rubbing sections 32 and 33.

Here, the thickness of the rubbing sections 32 and 33 made of polyethylene terephthalate resin is preferably not less than 0.05 mm and not more than 0.3 mm. This is because, when the thickness is less than 0.05 mm, it is impossible to obtain sufficient capability of transporting toner of the rubbing sections 32 and 33, and when the thickness exceeds 0.3 mm, the stiffness of the rubbing sections 32 and 33 becomes so high that the rubbing sections 32 and 33 move vertically or slide upwardly in the bottle main body 20 when scraping toner adhered to the inner wall surface of the bottle main body 20.

Figure 5:
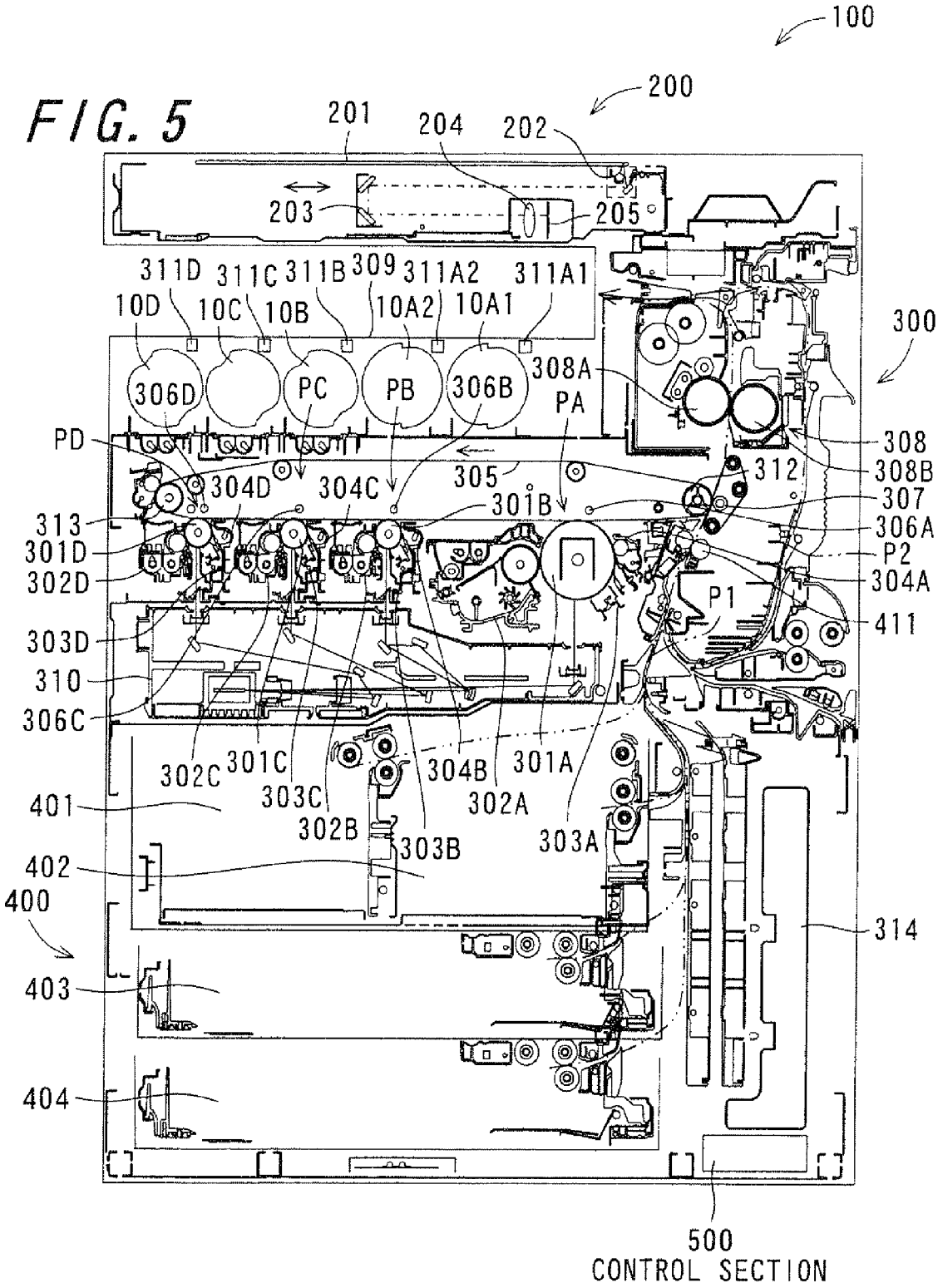
FIG. 5 is a view showing the structure of an image forming apparatus according to an embodiment of the invention.
Figure 6:
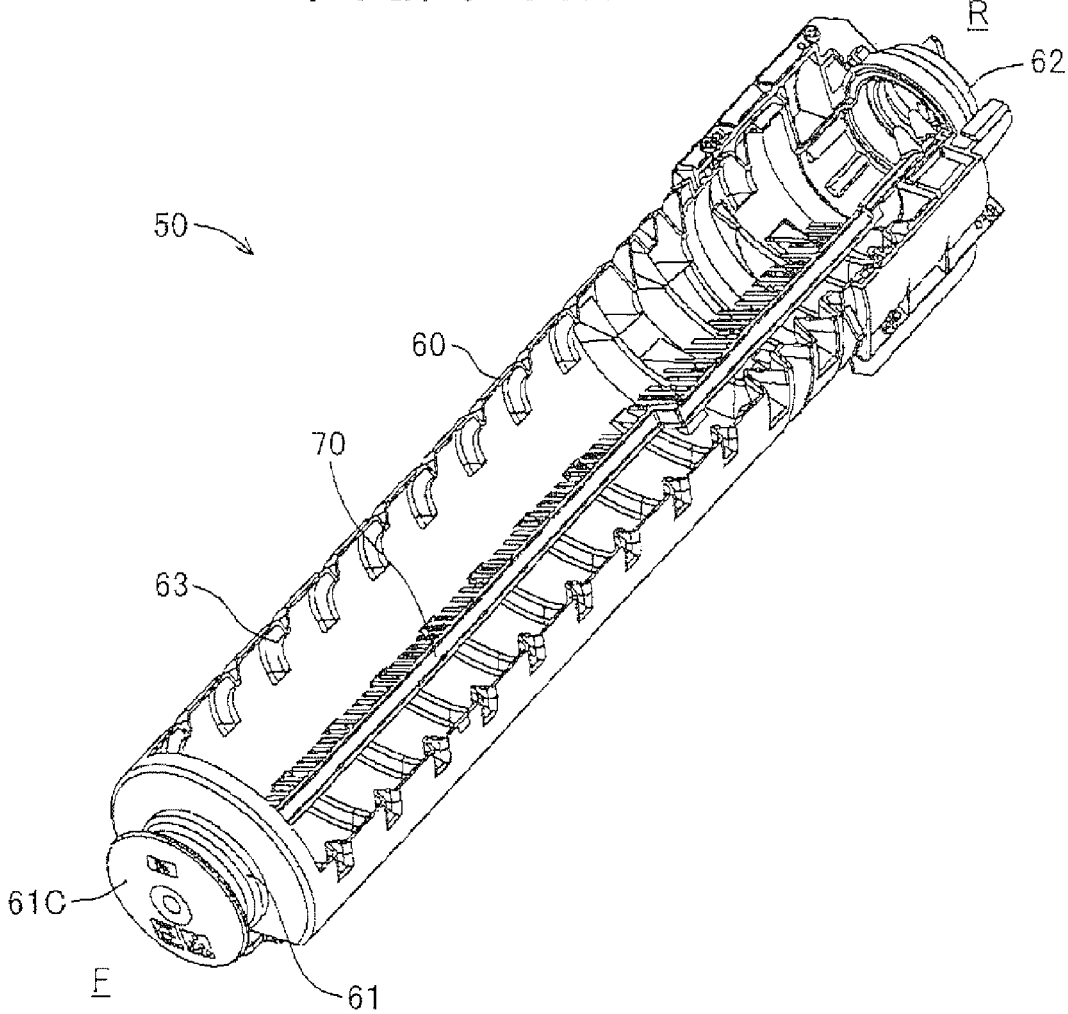
FIG. 6 PRIOR ART
FIG. 6 is a perspective view showing the structure of a toner bottle in a related art.
Figure 7:
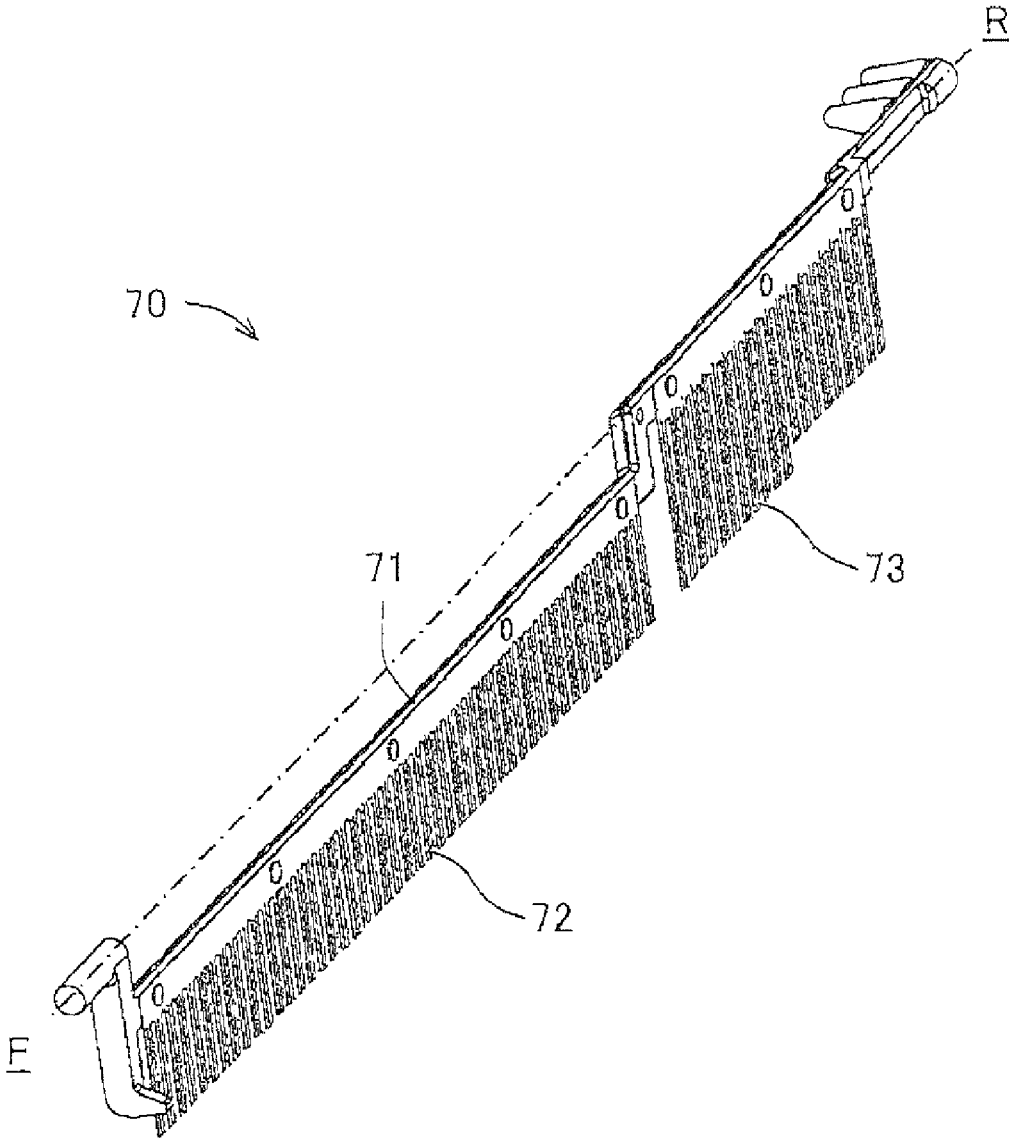
FIG. 7 PRIOR ART
FIG. 7 is a perspective view showing the structure of a scraping member disposed in a toner bottle.

FIG. 5 is a view showing the structure of the image forming apparatus 100 according to an embodiment of the invention. The image forming apparatus 100 is an apparatus for forming a full-color or monochrome image on a recoding medium such as recoding paper. The image forming apparatus 100 includes an image reading unit 200, an image recording unit 300, a paper supply unit 400 and a control section 500.

The image reading unit 200 includes a document platen 201, a first mirror base 202, a second mirror base 203, a focusing lens 204 and a CCD (charge coupled device) image sensor 205 which is a solid state imaging device. The document platen 201 is a member for placing a document to be read and is formed of a hard glass plate. The first mirror base 202 and the second mirror base 203 are provided so as to be movable in a horizontal direction below the document platen 201. A moving speed of the second mirror base 203 is half of the moving speed of the first mirror base 202. The first mirror base 202 is mounted with a light source and a first mirror. The second mirror base 203 is mounted with a second mirror and a third mirror.

When reading an image of a document placed on the document platen 201, the first mirror base 202 and the second mirror base 203 move below the document platen 201 in a horizontal direction. Light from the light source is irradiated to the image surface of the document placed on the document platen 201 and reflection light on the image surface of the document is reflected by the first mirror to the second mirror base 203. The reflection light on the image surface of the document, enters by the second mirror and the third mirror through the focusing lens 204 into the CCD image sensor 205, while an optical path length being made constant. The CCD image sensor 205 outputs electric signals corresponding to light quantity of the reflection light on the image surface of the document. The electric signals are input into the image recording unit 300 as image data.

The image recording unit 300 is divided into four image forming sections PA, PB, PC, and PD for corresponding to image data in each of four colors; black (K) and the three primary colors for subtractive color blending obtained by color separation of a color image, cyan (C), magenta (M), and yellow (Y). Here, members constituting the image forming sections PA, PB, PC, and PD provided corresponding to the colors, respectively are denoted by reference marks of an alphabet A for black, an alphabet B for cyan, an alphabet C for magenta, and an alphabet D for yellow at the end of the reference marks for distinction, and only reference mark is used when referred to collectively.

The image recording unit 300 includes an exposure unit 310, a photoreceptor drum 301, a developing section 302, a charging section 303, a cleaning section 304, an intermediate transfer belt 305, a primary transfer roller 306, a secondary transfer roller 307, a fixing section 308, paper transport paths P1 and P2, a discharge tray 309 and the aforementioned toner bottle 10 of the invention.

The toner bottle 10 is provided in each of predetermined bottle storing sections so as to be detachable. The toner bottle 10 is replaced with another toner bottle having the same shape as necessary, for example, when it is detected that toner contained inside is empty.

The toner bottles 10A1 and 10A2 contain black toner and supply black toner through a supply channel (not shown) to the developing section 302A. The toner bottle 10B contains cyan toner and supplies cyan toner through a supply channel (not shown) to the developing section 302B. The toner bottle 10C contains magenta toner and supplies magenta toner through a supply channel (not shown) to the developing section 302C. The toner bottle 10D contains yellow toner and supplies yellow toner through a supply channel (not shown) to the developing section 302D.

Each of the toner bottles 10A1, 10A2, 10B, 10C, and 10D is rotated by a driving force supplied from each of driving sources 311A1, 311A2, 311B, 311C, and 311D, respectively.

The image forming section for black PA includes a photoreceptor drum 301A, a developing section 302A, a charging section 303A, a primary transfer roller 306A, a cleaning section 304A and the like. The image forming sections PA, PB, PC, and PD are arranged in a row in a moving direction of the intermediate transfer belt 305.

The photoreceptor drum 301A has a larger diameter compared to the photoreceptor drums 301B to 301D. This is because, in monochrome image formation using only the image forming section for black PA, high-speeding is highly demanded and usage frequency is higher than color image formation using all of the image forming sections PA to PD, therefore the photoreceptor drum 301A provided in the image forming section for black PA is required to have longer life than the photoreceptor drums 301B to 301D. The photoreceptor drums 301B to 301D have the same diameter to each other. Accordingly, an interval between the axis of rotation of the photoreceptor drum 301A and the axis of rotation of the photoreceptor drum 301B is longer than an interval between axes of rotation of the photoreceptor drums 301B to 301D.

The charging section 303A charges the surface of the photoreceptor drum 301A uniformly to a predetermined potential. Each of the charging sections 303B to 303D is constituted in the same manner as the charging section 303A.

The exposure unit 310 includes a semiconductor laser, a polygonal mirror, a first fθ lens and a second fθ lens, which are not shown, and irradiates each laser beam modulated in accordance with image data in each color of black, cyan, magenta and yellow to each of the photoreceptor drums 301A to 301D. Each of the photoreceptor drums 301A to 301D is formed with an electrostatic latent image in accordance with image data in each color of black, cyan, magenta and yellow.

The developing section 302A supplies black toner to the surface of the photoreceptor drum 301A formed with an electrostatic latent image to visualize the electrostatic latent image to a toner imager. Each of the developing devices 302B to 302D develops an electrostatic latent image in the respective colors of black, cyan, magenta and yellow, formed on the respective photoreceptor drums 301B to 301D to a toner image in each color.

The cleaning section 304A collects toner remaining on the surface of the photoreceptor drum 301A after development and image transfer. Similarly to the cleaning section 304A, the cleaning sections 304B to 304D collect toner remaining on the surface of each of the photoreceptor drums 301B to 301D after development and image transfer.

The intermediate transfer belt 305 is stretched to be laid between a driving roller 312 and a driven roller 313 to form a loop-like moving path. The outer circumferential surface of the intermediate transfer belt 305 faces the photoreceptor drum 301D, the photoreceptor drum 301C, the photoreceptor drum 301B and the photoreceptor drum 301A in this order. The primary transfer rollers 306A to 306D are disposed at positions opposite to the respective photoreceptor drums 301A to 301D across the intermediate transfer belt 305. Each of the positions where the intermediate transfer belt 305 faces the photoreceptor drums 301A to 301D serve as primary transfer positions.

In order to transfer toner images carried on the surfaces of the photoreceptor drums 301A to 301D onto the intermediate transfer belt 305, the primary transfer rollers 306A to 306D are applied with a primary transfer bias having an opposite polarity to a charged polarity of toner by constant voltage control. Thereby, the toner images in respective colors formed on the photoreceptor drums 301A to 301D are successively transferred and overlaid onto the outer circumferential surface of the intermediate transfer belt 305 to form a full-color toner image.

However, when image data only in a part of yellow, magenta, cyan and black colors is input, an electrostatic latent image and a toner image are formed only on a part corresponding to the color of the input image data of four photoreceptor drums 301A to 301D. For example, in a monochrome printing mode, an electrostatic latent image and a toner image are formed only on the photoreceptor drum 301A corresponding to black color and only a black toner image is transferred to the outer circumferential surface of the intermediate transfer belt 305.

In full-color image formation where image formation is carried out in all of the image forming sections PA to PD, the primary transfer rollers 306A to 306D bring the intermediate transfer belt 305 into pressure-contact with all of the photoreceptor drums 301A to 301D. On the other hand, in a monochrome image formation where image formation is carried out only in the image forming section PA, only the primary transfer roller 306A brings the intermediate transfer belt 305 into pressure-contact with the photoreceptor drum 301A.

Each of the primary transfer rollers 306A to 306D has a shaft made of metal (for example, stainless steel) having a diameter of 8 to 10 mm and a conductive elastic material (for example, EPDM, foam urethane) with which a surface of the shaft is covered, and applies a high voltage to the intermediate transfer belt 305 uniformly by the conductive elastic material.

A toner image transferred on the outer circumferential surface of the intermediate transfer belt 305 at each of the primary transfer positions is transferred by rotation of the intermediate transfer belt 305 to a secondary transfer position located opposite to the secondary transfer roller 307. In image formation, the secondary transfer roller 307 is brought into pressure-contact with the outer circumferential surface of the intermediate transfer belt 305 whose inner circumferential surface is in contact with the circumferential surface of the driving roller 312 to a predetermined nip pressure.

When a sheet supplied from the paper supply unit 400 passes through a gap between the secondary transfer roller 307 and the intermediate transfer belt 305, a high voltage having an opposite polarity to the charged polarity of toner is applied to the secondary transfer roller 307. Thereby, a toner image is transferred to the surface of the sheet from the outer circumferential surface of the intermediate transfer belt 305.

The paper having the toner image transferred thereto is guided to the fixing section 308, and passes through a gap between a heat roller 308A and a pressure roller 308B to be heated and pressed. Thereby, the toner image is fixed strongly to the surface of the sheet. The sheet having the toner image fixed thereto is discharged to the discharge tray 309.

The paper transport path P1 is disposed in a substantially vertical direction for transporting a sheet stored in the paper supply unit 400 through a gap between the secondary transfer roller 307 and the intermediate transfer belt 305, and the fixing section 308 to the discharge tray 309.

The paper transport path P2 is disposed extending from the downstream side of the fixing section 308 to the upstream side of the second transfer position in a transporting direction of a paper. To the paper transport path P2, a sheet that has passed through the fixing section 308 and discharged to the discharge tray 309 is transported with the end edge turning to front. Thereby, the sheet is returned to the second transfer position with the sheet turned upside down.

The paper supply unit 400 includes paper feed cassettes 401, 402, 403 and 404. Each of the paper feed cassettes 401, 402, 403 and 404 stores a plurality of sheets in the same size. The paper-supplying unit 400 feeds a sheet one by one from any of the paper feed cassettes 401, 402, 403 and 404. The sheet supplied from the paper supply unit 400 is transported through the paper transport path P1 to the secondary transfer position.

A registration roller 411 is disposed in the upstream side between the secondary transfer roller 307 and the driving roller 312 in the paper transporting direction. The sheets supplied from the paper feed cassettes 401, 402, 403 and 404 have front ends butted to the registration roller 411 while the registration roller 411 is stopped. The axis of rotation of the registration roller 411 is disposed in a direction perpendicular to the sheet transporting direction. When the front end of the sheet is butted to the stopped registration roller 411, a skew of the sheet is corrected when the sheet is skewed.

The registration roller 411 starts the rotation at a timing to match the front end of the sheet with the front end of a toner image formed on the surface of the intermediate transfer belt 305 and feeds the sheet to the secondary transfer position. The toner image is transferred and fixed to the sheet, and the sheet is discharged to the discharge tray 309.

At the bottom of the image forming apparatus 100, a waste toner box 314 is disposed. In the waste toner box, toner collected from the surfaces of the photoreceptor drums 301A to 301D by the cleaning sections 304A to 304D is contained.

The image forming apparatus 100 has the toner bottle 10 for supplying toner contained therein to the developing section 302. In the toner bottle 10, as described above, the scraping member 30 rubs the inner wall surface of the bottle main body 20 efficiently in the whole area in the direction in which the axis of rotation of the bottle main body 20 extends while guiding and transporting toner to the opening. Thus, toner is efficiently transported while suppressing generation of toner aggregation caused by residual toner in the bottle main body 20. Since the image forming apparatus 100 has such a toner bottle 10, it is possible to form an image on a sheet in a state where toner is efficiently supplied to the developing section 302 for developing an electrostatic latent image on the surface of the photoreceptor drum 301 with toner.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner bottle for containing toner to be supplied to a developing section for developing an electrostatic latent image on a surface of a photoreceptor, comprising:

a bottle main body in a cylindrical shape for supplying toner contained therein to the developing section by rotation of the bottle main body; and a rubbing member disposed inside the bottle main body for rubbing an inner wall surface of the bottle main body by rotation of the bottle main body, wherein the bottle main body has:

a toner opening which serves as an outlet for supplying toner to the developing section; and one or more ribs protruding from the inner wall surface of the bottle main body and formed in a discrete manner, for guiding and transporting toner to the toner opening by rotation of the bottle main body, wherein the rubbing member has:

a shaft section disposed over a whole area in a direction in which an axis of rotation of the bottle main body extends; and a rubbing section having one end supported by the shaft section and another end formed so as to be in contact with the inner wall surface of the bottle main body, wherein the shaft section has an inclined support section, a longitudinal axis of the inclined support section extending at a predetermined angle with respect to the axis of rotation of the bottle main body, and wherein the rubbing section is supported by the inclined support section so as to extend in a direction perpendicular to the longitudinal axis of the inclined support section.

2. The toner bottle of claim 1, wherein the shaft section has a plurality of the inclined support sections formed repeatedly.

3. The toner bottle of claim 1, wherein the rubbing section is a comb-like sheet member.

4. The toner bottle of claim 1, wherein the rubbing section is made of polyethylene terephthalate resin.

5. The toner bottle of claim 4, wherein the rubbing section made of polyethylene terephthalate resin has a thickness of not less than 0.05 mm and not more than 0.3 mm.

6. The toner bottle of claim 2, wherein each angle formed between the longitudinal axis of the inclined support sections and the axis of rotation of the bottle main body is set to not less than 5° and not more than 30°.

7. The toner bottle of claim 2, wherein the angle formed between the rotational axis of the bottle main body and the longitudinal axis of the inclined support section located closest to the toner opening is set to be larger than the angle formed between the rotational axis of the bottle main body and an inclined support section located further away from the toner opening.

8. An image forming apparatus comprising an image recording unit including a developing section for developing an electrostatic latent image on a surface of a photoreceptor drum with toner, and the toner bottle of claim 1, wherein the toner bottle is adapted to supply toner to the developing section.

9. The toner bottle of claim 1, wherein the shaft section has a plurality of inclined support sections, and wherein a longitudinal axis of each of the plurality of inclined support sections extends at a predetermined angle with respect to the axis of rotation of the bottle main body.

10. The toner bottle of claim 9, wherein the predetermined angles formed between the longitudinal axes of the inclined support sections and the axis of rotation of the bottle main body are not less than 5° and not more than 30°.

11. The toner bottle of claim 9, wherein an angle formed between the axis of rotation and the longitudinal axis of a first inclined support section that is located closest to the toner opening is greater than an angle formed between the axis of rotation and the longitudinal axis of a second inclined support section located further away from the toner opening than the first inclined support section.

12. The toner bottle of claim 9, wherein the angles formed between the axis of rotation and the longitudinal axes of the plurality of inclined support sections vary along a length of the rubbing member.

13. The toner bottle of claim 9, wherein a length of a first inclined support section located closest to the toner opening is shorter than a length of a second inclined support section located further away from the toner opening than the first inclined support section.

14. The toner bottle of claim 9, wherein the lengths of the plurality of inclined support sections vary along a length of the rubbing member.

15. The toner bottle of claim 9, wherein a length of the rubbing sections supported by the plurality of inclined support sections varies along a length of the rubbing member.

* * * * *